US005097630A

United States Patent [19]

Maeda et al.

[11] Patent Number: 5,097,630

[45] Date of Patent: Mar. 24, 1992

[54] SPECULAR MACHINING APPARATUS FOR PERIPHERAL EDGE PORTION OF WAFER

[75] Inventors: Seiichi Maeda, Ayase; Isao Nagahashi, Fujisawa, both of Japan

[73] Assignee: Speedfam Co., Ltd., Ayase, Japan

[21] Appl. No.: 243,979

[22] Filed: Sep. 13, 1988

[30] Foreign Application Priority Data

Sep. 14, 1987 [JP] Japan ..... 62-230399

[51] Int. Cl.[5] ..... B24B 5/00; B24B 47/02

[52] U.S. Cl. ..... 51/50 R; 51/42; 51/80 R; 51/89; 51/105 R; 51/106 R; 51/215 HM; 51/237 R

[58] Field of Search ..... 51/106 LG, 106 R, 89, 51/235, 215 R, 215 AR, 215 HM, 215 UE, 237 R, 33 W, 42, 48 R, 50 R, 31, 80 R, 103 R, 104, 105 R, 283 R, 283 E

[56] References Cited

U.S. PATENT DOCUMENTS

| | | | |
|---|---|---|---|
| 3,943,666 | 3/1976 | Dion et al. | 51/51 |
| 4,262,452 | 4/1981 | Lopez | 51/106 R |
| 4,417,422 | 11/1983 | Redeker | 51/50 R |
| 4,453,347 | 6/1984 | Redeker | 51/215 HM |
| 4,753,049 | 6/1988 | Mori | 51/215 AM |

FOREIGN PATENT DOCUMENTS

| | | | |
|---|---|---|---|
| 0118447 | 6/1985 | Japan | 51/235 |
| 1667679 | 1/1973 | U.S.S.R. | 51/283 E |
| 1146179 | 3/1985 | U.S.S.R. | 51/106 R |
| 12114 | of 1907 | United Kingdom | 51/106 R |

*Primary Examiner*—Bruce M. Kisliuk
*Assistant Examiner*—John A. Marlott
*Attorney, Agent, or Firm*—Allegretti & Witcoff

[57] ABSTRACT

A specular machining apparatus for giving a specular machining or mirror-like surface to a peripheral edge portion, in particular a chamfered portion, of typically a semiconductor wafer such as a silicon wafer. This mirror-like surface is provided to smooth out the relatively rough surface formed by etching to remove a strained layer which is generated as a result of grinding work. The mirror-like surface tends to reject the attachment of dirt, which is desirable. The specular machining apparatus is of simple construction and easy to use, comprising a chuck table plus chuck means for holding a wafer having a chamfered peripheral edge portion. The chuck table rotates the wafer held by the chuck about the wafer axis. A polishing ring is disposed to be freely rotatable around an axis perpendicular to the axis of the wafer on the chuck table, to permit the polishing surface on the outer periphery to be accessable for polishing.

14 Claims, 4 Drawing Sheets

SPECULAR MACHINING APPARATUS FOR PERIPHERAL EDGE PORTION OF WAFER

TECHNICAL FIELD OF THE INVENTION

The present invention relates to a specular machining apparatus for giving specular machining to a peripheral edge portion of a semiconductor wafer.

DESCRIPTION OF THE PRIOR ART

The peripheral edge portion of a semiconductor wafer, such as a silicon wafer, is usually given a chamfer machining in order to preclude the chipping of the edges or to preclude the crowning during the epitaxial growth.

In such a chamfer machining which is done by grinding with a diamond grinding wheel, a strained layer due to machining is apt to be left behind after the grinding. When such a strained layer due to machining remains in a wafer, there is sometimes developed a crystal defect while the wafer is subjected to repeated heat treatment during the device process.

For this reason, the strained layer caused by machining is usually arranged to be removed by etching. The etched surface, however, tends to trap dirt because of its undulatory or scale-like uneveness. If even a small amount of dirt is left in the chamfered portion, the dirt will be diffused all over the wafer during the device process, which detriorates the characteristics of the wafer.

Accordingly, in order to improve the accuracy of the wafer, it is important to give a specular finish which makes it hard for dirt to settle, to the surface of the chamfered portion. In particular, the necessity for giving a specular machining to the chamfered portion is increasingly high at the present time where high level of LSI integration is in progress.

In spite of this, apparatus for providing specular machining to the chamfered portion of a wafer has not been proposed so that appearance of such an apparatus has been waited earnestly.

DISCLOSURE OF THE INVENTION

It is the main object of the present invention to provides a specular machining apparatus with a simple construction such that it is capable of giving a specular machining to peripheral edge portion, in particular, in a chamfered portion of a wafer.

It is another object of the present invention to provide a specular machining apparatus which is capable of reliably giving a specular machining to the peripheral edge portion of a wafer whose both surfaces in the front and rear are given chamfer machining.

It is another object of the present invention to provide a specular machining apparatus which can be used commonly for various kinds of wafers with varying thickness and angle of chamfer.

It is still another object of the present invention to provide a specular machining apparatus which is capable of bringing a polishing ring into contact with a chamfered portion of a wafer under appropriate force and condition, in order to enhance the accuracy of specular machining of the wafer.

It is another object of the present invention to provide a specular machining apparatus which enables an automatic feed of a wafer to be machined to a position for specular machining, as well as an automatic takeoff of a machined wafer from the position for specular machining.

In order to attain the above objects, the specular machining apparatus of the present invention consists of a chuck table, equiped with a chuck means for holding a wafer with its peripheral edge portion chamfered, for rotating the wafer held by the chuck means around the axis of the wafer, and a polishing ring, formed by pasting a piece of polishing cloth on the outer peripheral surface, so disposed as to be freely rotatable around an axis that is perpendicular to the axis of the wafer held on the chuck table, and its outer peripheral polishing surface to be able to come into contact with and recede from the chamfered portion of the wafer.

In the above specular machining apparatus, when a wafer is supplied on the chuck table, the wafer is held by a chuck on the chuck table, and is rotated at a low speed around its axis by the chuck table. Then, the polishing ring approaches the wafer while rotating around an axis which is perpendicular to the wafer axis, its polishing surface on the outer periphery is brought into contact with the wafer, and specular machining of the chamfered portion is carried out.

In the case of machining a wafer which is given chamfer machining on both of the front and rear surfaces, there are provided a front polishing ring for polishing the chamfered portion on the front surface side and a rear polishing ring for polishing the chamfered portion on the rear surface side, disposed so as to be rotatable in mutually opposite directions with the axis of these polishing rings shifted slightly in the vertical direction. In this case, it is possible to machine wafers of various thickness by allowing the inter-axial distance of the polishing rings to be adjustable.

In addition, by choosing the diameter of the polishing ring to be sufficiently large compared with the width of the chamfered portion of the wafer, as well as by choosing the width of the polishing ring to be sufficiently small compared with the wafer diameter, it becomes possible to bring the entire polishing surface of the polishing ring into contact with the entire width of the chamfered portion, therefore preventing biased wear of the polishing surface and the associated decrease in the machining accuracy.

Besides the polishing ring for giving a specular machining to the chamfered portion, there may be provided a polishing drum for polishing the peripheral flank of a wafer to give it a specular machining. By choosing a constitution which permits bringing the polishing ring and the polishing drum into constant contact with the wafer under a constant force by means, for example, of a pushing force setting means which makes use of the gravitational force that acts on a weight, it becomes possible to carry out constant specular machining under a fixed condition irrespective of the form of the wafer.

Moreover, the above specular machining apparatus can be automated by equipping it with a wafer transporting device for taking-out a machined wafer placed on the chuck table to a takeout position and for bringing-in an unmachined wafer placed on a supply position onto the chuck table, a supply means for sending out unmachined wafers housed in a carrier one at a time to the supply position, and a takeout means for housing a machined wafer taken out to the takeout position and a washing device for washing machined wafer with a washing brush by jetting a washing solution on the wafer prior to housing it.

DETAILED DESCRIPTION OF THE EMBODIMENT

In what follows, an embodiment of the present invention will be described in detail by making reference to the figures.

Figure 1:
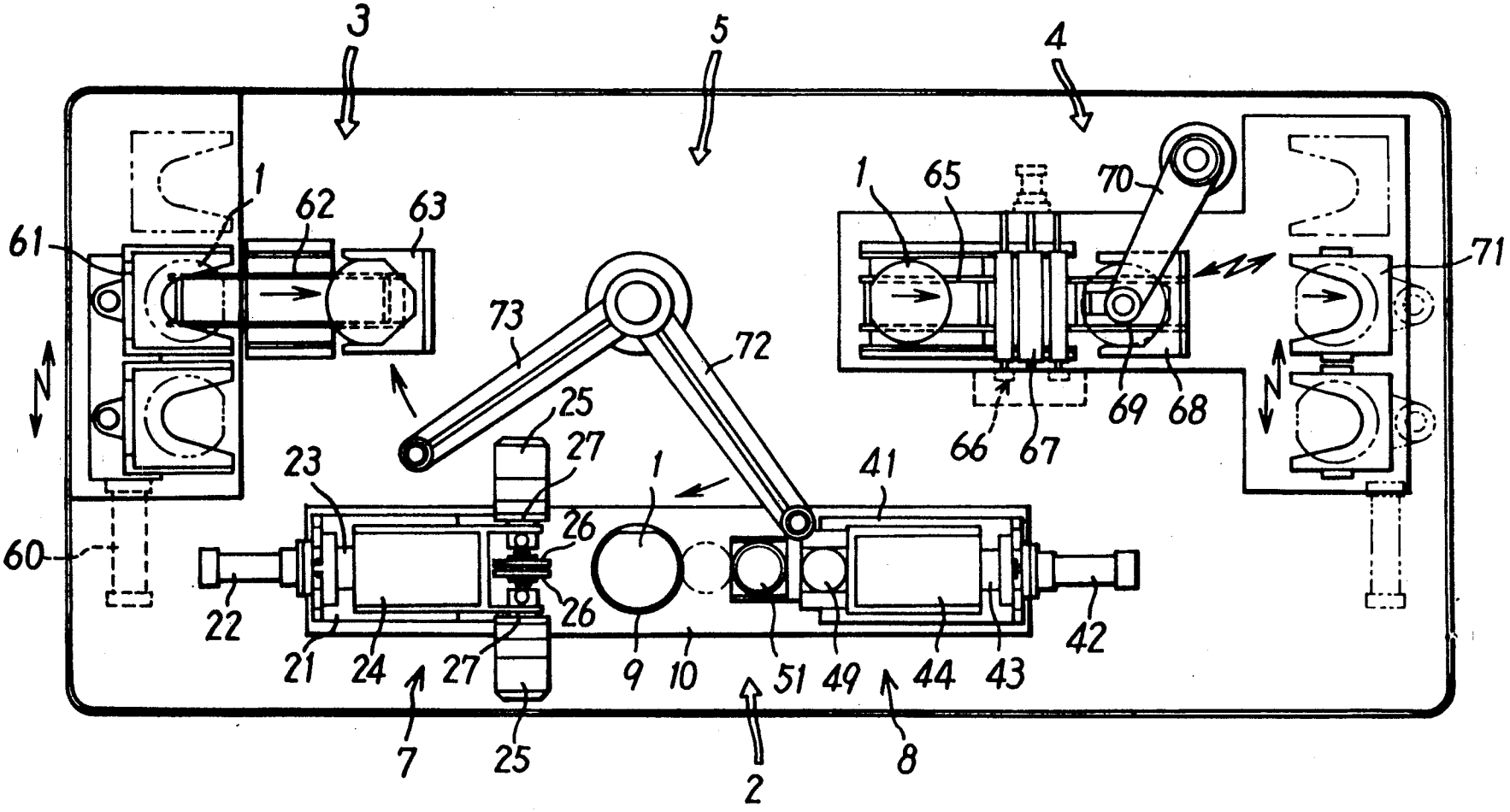
FIG. 1 is a plan view showing an embodiment of the present invention.

A specular machining apparatus shown in FIG. 1 is for automating the entire operation, from machining to supply and take-out, of a wafer 1, and comprises a machining part 2 for giving a specular machining to the periphery of a wafer, both surfaces of which are chamfered at the peripheral edge portion (see FIG. 5), a loader part 3 for supplying an unmachined wafer to the machining part 2, an unloader part 4 for taking out a machined wafer from the machining part 2, a transporting device 5 for transporting a wafer to and from the machining part 2, the loader part 3 and the unloader part 4 by a swiveling notion, a control means (not shown) for automatically controlling each of the parts 2, 3 and 4 and the transporting device 5 in accordance with a prescribed program.

Figure 2:
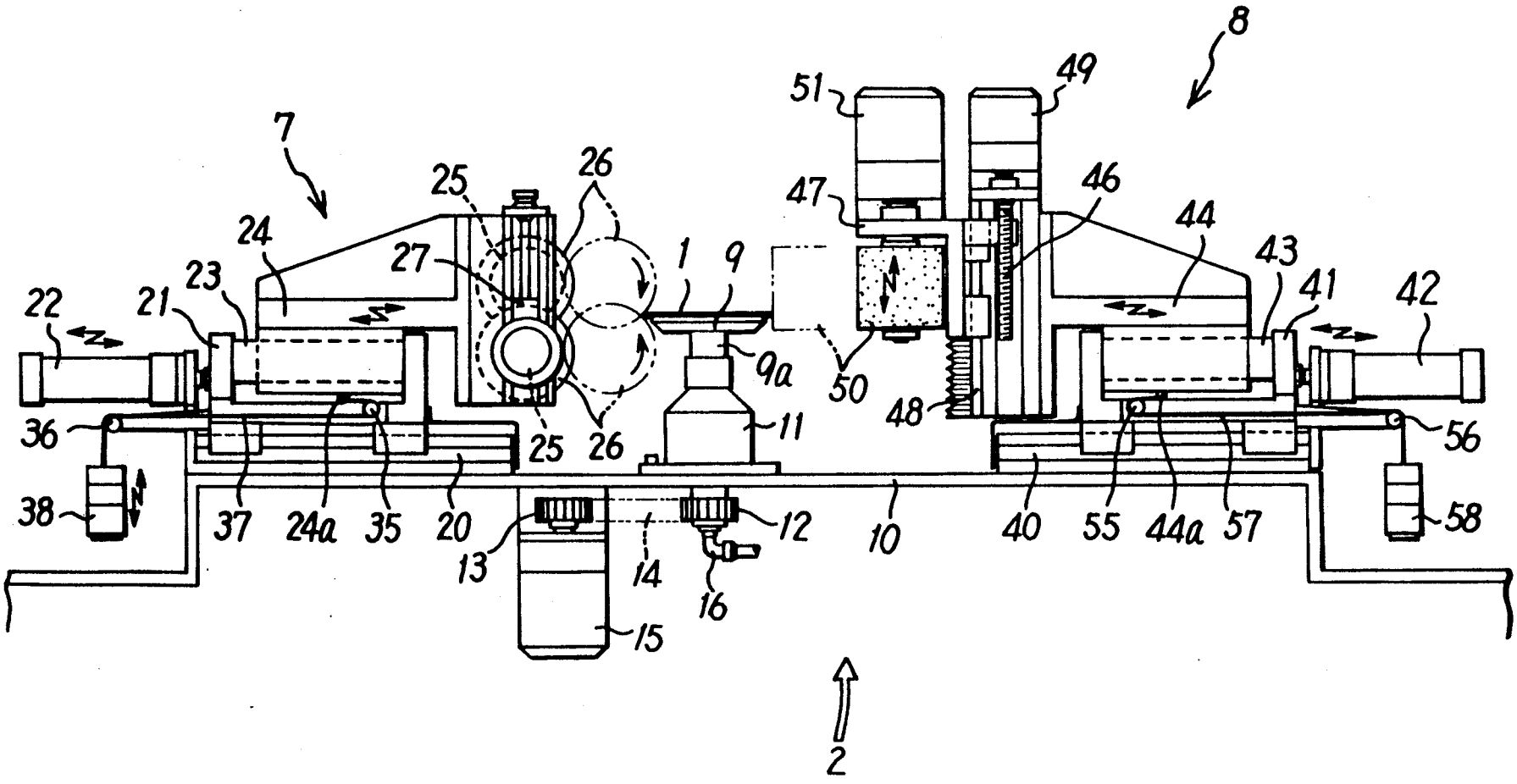
FIG. 2 is an enlarged front view of its important parts.

As may be clear from FIG. 2, the machining part 2 is equipped with a chamfered portion machining device 7 for giving a specular machining to the chamfered portions is (see FIG. 5) of a wafer placed on a chuck table 9 and a peripheral flank machining device 8 for giving a specular machining to the peripheral flank 1*b* (see FIG. 5) of the wafer 1, and has a detailed construction as described below.

Namely, a table supporting member 11 is provided on a machine bed 10 of the machining apparatus, the chuck table 9 is supported on the table supporting member 11 freely rotatably around a vertical shaft line, and the drive shaft 9*a* of the chuck table 9 is linked to a driving source 15 such as a motor via pulleys 12 and 13 and a belt 14 to be driven at a low speed, for example, of about 1–10 rpm. On the top surface of the chuck table 9, there is provided a chuck means for vacuum-chucking the wafer 1, and the chuck means is connected to a sucking pump, which is not shown, through a sucking tube 16 which penetrates through the drive shaft 9*a*.

Figure 4:
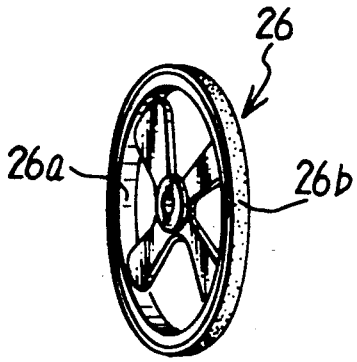
FIG. 4 is a perspective view of the polishing ring.

Further, the chamfered portion machining device 7 has a slide table 21 which can be slid along a slide rail 20 on a machine by means of a cylinder 22. On the slide table 21, a polishing ring attaching member 24 is mounted freely movably in the direction of a chuck table 9 via an airslide mechanism 23 whose sliding resistance is reduced by interposing air in the sliding part. On the tip of the polishing ring attaching member 24, there are mounted two motors 25 at positions shifted slightly in the vertical direction so as to face with each other, with thin polishing rings 26 attached to the rotation shafts on the respective motors 25. Each of these polishing rings 26 is constructed by pasting a piece of polishing cloth 26*b* on the other peripheral surface of a short cylindrical ring member 26*a*, as shown in FIG. 4. The rings 26 are disposed so as to rotate in the mutually opposite directions around shafts that are perpendicular to the axis of the wafer 1, keeping some distance in the circumferential direction of the wafer 1 that is held on the chuck table 9. The polishing surfaces on the outer periphery are arranged to come into contact with and recede from the chamfered portions 1*a* of the wafer 1 by the sliding of the slide table 21. In so doing, the polishing rings 26 approach and leave the upper chamfered portion 1*a* and the lower chamfered portion 1*a*, respectively.

Figure 5:
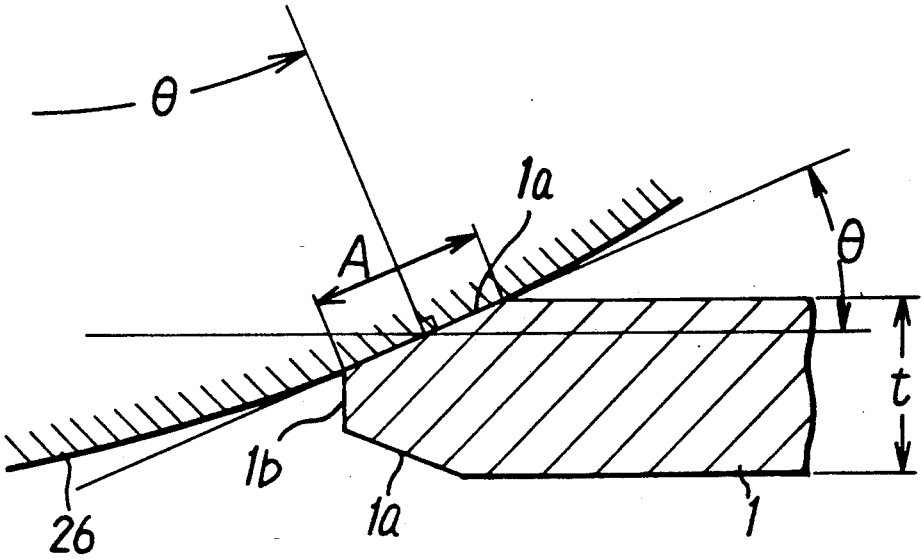
FIG. 5 is an enlaraged sectional diagram of important parts in the state in which the polishing ring is pushed against the chamfered portion of the wafer.
Figure 6:
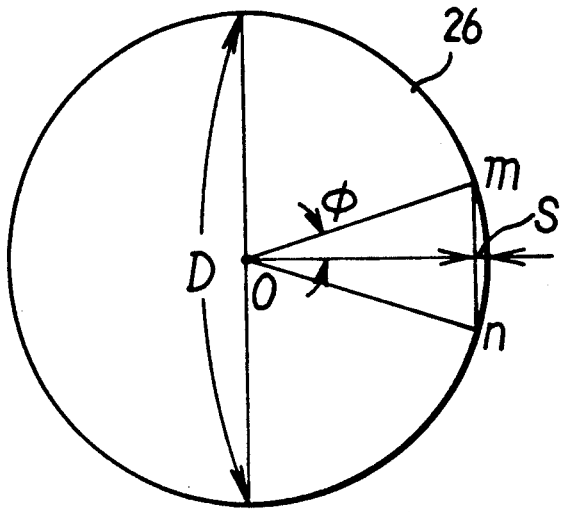
FIG. 6 is an explanatory diagram for illustrating the dimensional condition of the polishing ring.
Figure 7:
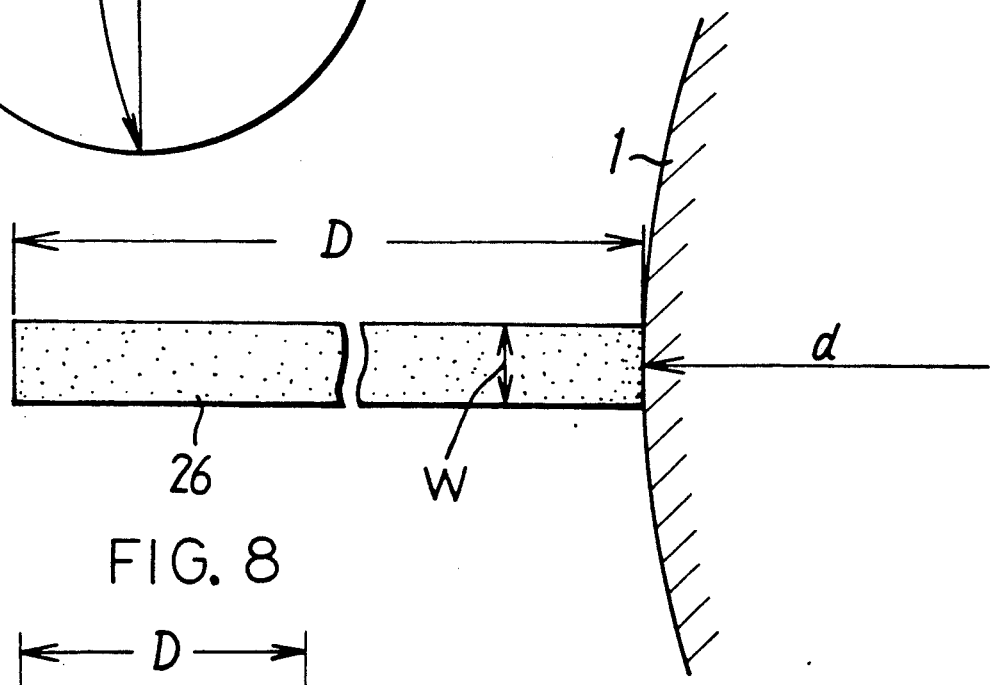
FIG. 7 is an explanatory diagram for illustrating the dimensional relationship between the polishing ring and the wafer.

As shown in FIG. 5 to FIG. 7, the polishing ring 26 is formed in such a way as to have its diameter D to be sufficiently large compared with the width A of the chamfered portion 1*a*, while its width W to be sufficiently small compared with the diameter d of the wafer 1. With this arrangement, the polishing ring 26 is made to come into contact with the entier width A of the chamfered portion 1*a* over its entire width W. Further, the distance between the centers of the polishing rings 26 (see FIG. 8) is arranged to be adjustable by vertically shifting the brackets 26 on which the motors 25 are mounted.

In order to push, at the time of machining, the polishing rings 26 against the chamfered portion 1*a* of the wafer 1, these are installed two pulleys 35 and 36 in the slide table 21. On the pulleys 35 and 36, there is wound rope of which one end is fixed to a projection 24*a* of the polishing ring attaching member 24 and whose other end is connected to a weight 38 which is suspended from there. With this arrangement, when the slide table 21 moves forward to the chuck table 9 under the action of the cylinder 22, the polishing rings 26 are pushed against the wafer 1 just before the slide table comes to the end of the stroke, with the polishing ring attaching member 24 receding relative to the slide table 21 while pulling the weight 38 upward. In this case, the pushing force mentioned above is provided by the gravitational force of the weight 38 that acts on the polishing ring attaching member 24. Although the magnitude of the pushing force varies with the machining conditions, it is set appropriately by considering the balance with the holding force of the wafer 1 by the chuck table 9, strength of the polishing cloth, and so forth.

Moreover, a peripheral flank machining device 8 is similar to the case of the chamfered portion polishing member 7 in that a polishing drum attaching member 44 is mounted freely movably on a slide table 41 that is driven along a slide rail 40 by the action of a cylinder 42 via an airslide mechanism 43. On the tip of the polishing drum attaching member 44, there is mounted an elevating motor 49 which lifts and lowers a bracket 47 that is screwed to a screw rod 46 along a guide bar 48 by the drive of the screw rod 46. On the bracket 47, a polishing drum 50 for giving specular machining to the peripheral flank 1*b* of the wafer 1 is supported rotatably around a shaft parallel to the wafer axis, and also a drum drive motor 51 for driving the drum 50 is mounted.

The polishing drum 50 is constructed by pasting a piece of polishing cloth on the outer surface of the cylindrical drum member.

Further, since the mechanism for pushing the polishing drum 50 to the flank of the wafer 1 under a constant force, at the time of machining, is similar to that of the chamfered portion machining device 7, identical components are assigned numerals obtained by adding 20 to those of corresponding components in the case of the chamfered portion machining device 7, and further description is omitted.

In addition, supply nozzles of a chemical polishing agent are provided, though not shown, in the areas where the polishing rings 26 and the polishing drum 50 are brought into contact with the wafer, and the chemical polishing agent is arranged to be supplied from the nozzles at the time of machining.

As shown in FIG. 1, the loader part 3 which supplies an unmachined wafer 1 to a machining part 2, takes out wafers 1 housed in stacked form, one by one with a conveyor 62, from a carrier 61 that is sent in succession by the action of a cylinder 60, and transports the wafer to a supply position where it comes into contact with a positioning guide 63.

Figure 3:
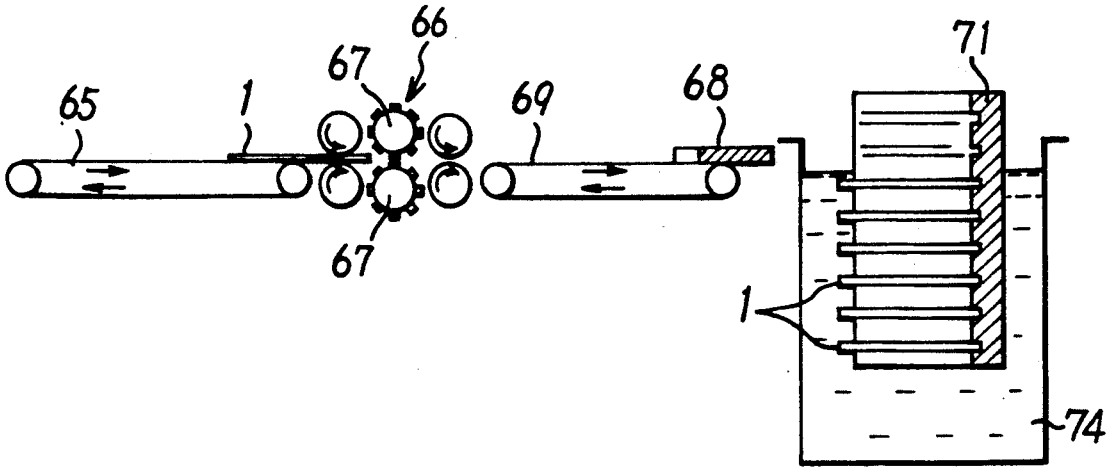
FIG. 3 is a simplified structural diagram for the unloader part.

Moreover, an unloader part 4 is composed, as shown in FIG. 1 and FIG. 3, of a receiving conveyor 65 which receives a wafer from a transporting device 5, a washing device 66 for washing the wafer 1 from the receiving conveyor 65 with a washing brush 67 while subjecting the wafer to jet of washing solution such as deionized water, a takeout conveyor 69 for transporting the washed wafer 1 to a takeout position which makes contact with a positioning guide 68, and a takeout arm 70 for successively housing wafers 1 at the takeout position in a carrier 71. The carrier 71 lowers successively each time a wafer 1 is housed, and the wafer 1 is immersed in a water tank 74 to prevent drying of the wafer.

Further, after simultaneous sucking of a machined wafer 1 located on the chuck table 9 and an unmachined wafer 1 placed at the supply position of the loader part 3 with sucking means formed on the tips of the respective arms 72 and 73, the transporting device 5 equipped with two arms 72 and 73 that are provided with a spread of 90°, places the machined wafer 1 on the receiving conveyor 65 in the unloader part 4 and supplies an unmachined wafer 1 onto the chuck table 9, through a turning of 90° of the transporting device 5. The transporting device 5 is usually waiting at a neutral position shown in FIG. 1.

Next, the operation of the specular machining apparatus with the above constitution will be described. Operation When a wafer 1 is supplied from the loader part 3 by the transporting device 5 onto the chuck table 9, the wafer is sucked and fixed to the table by a chuck means, and the chuck table starts to rotate. At the same time, the polishing rings 26 of the chamfered portion machining device 7 and the polishing drum of the peripheral flank machining device 8 also start to rotate.

Subsequently, slide tables 21 and 41 move forward under the action of the cylinders 22 and 42 of the machining device 7 and 8, respectively, and the two polishing rings 26 of the chamfered portion machining device 7 are brought into contact with the respective chamfered portions 1*a*, and the polishing drum 50 of the peripheral flank machining device 8 is brought into contact with the peripheral flank 1*b* of the wafer 1. The pushing force of the polishing rings 26 and of the polishing drum 50 at this time is produced by the gravitational force of the weights 38 and 58 that act on the attaching members 24 and 44, because the attaching members 24 and 44 recede relative to the slide tables 21 and 41 while pulling up the weights 38 and 58 by the action of the air-slide mechanisms 23 and 43, through the contact of the polishing rings 26 and the polishing drum 50 with the wafer 1 just before the slide tables 21 and 41 come to the end of the respective strokes.

Now, the above method of supporting the attaching members 24 and 44 by means of the airslide mechanisms 23 and 43, at the time of bringing the polishing rings 26 and the polishing drum 50 into contact with the wafer 1, is capable of reliably bringing the polishing rings 26 and the polishing drum 50 to the wafer 1 by copying the form of the wafer even for the case when the wafer is not circular in form, for example, in the case where one or plural orientation flats are formed on the flank of the wafer, so that this method is applicable to give a specular machining to a wafer irrespective of its form.

Further, immediately before bringing the polishing rings 26 and the polishing drum 50 into contact with the wafer 1, a chemical polishing agent is supplied to their areas of contact through nozzles, and specular machining of the chamfered portions 1*a* and the peripheral flank 1*b* is carried out respectively under the supply of the chemical polishing agent.

Here, let us consider the case of machining the chamfered portion 1*a* with the polishing ring 26. As shown in FIG. 5, in contrast to the chamfered portion 1*a* which is linear in its direction of inclination, the polishing surface of the polishing ring 26 is curved. Since, however, the diameter D of the polishing ring 26 is set to be sufficiently large compared with the width A of the chamfered portion 1*a* (for example, D=110 mm and A=0.3 mm), it can be regarded that the polishing ring 26 makes a linear contact over its entire width with the chamfered portion 1*a*. Namely, in FIG. 6, when the polishing ring 26 is considered to make a contact with the chamfered portion 1*a* over the region between m and n, for D=110 mm and A=0.3 mm as in the above, and for 0=22° of the angle of chamfer in FIG. 5, result of calculation shows that the distance s between the centers of the line segment mn and the circular are mn is about 0.2 um. Since this value of s is very small compared with the line segment mn(=0.3 mm), it can be neglected in the discussion of the accuracy of chamfering. Moreover, the width W of the polishing ring 26 is set to be sufficiently small compared with the diameter of the wafer 1, as shown in FIG. 7, the polishing ring 26 may be considered to make a contact with the chamfered portion 1*a* with its entire width.

Figure 8:
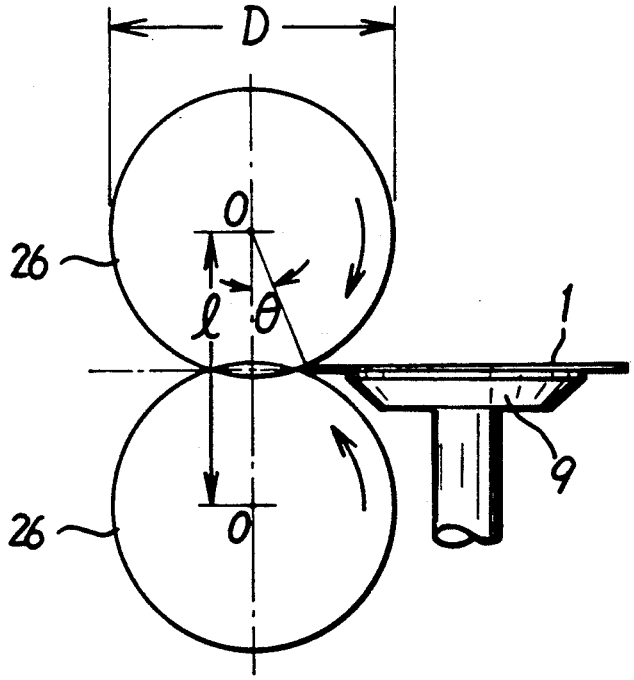
FIG. 8 is a side view of important parts for illustrating the principle of polishing.

Furthermore, as shown in FIG. 8, the distance l between the centers of the two polishing rings 26 can be adjusted in accordance with the thickness t or the like of the wafer 1. In other words, it is possible to deal with various kinds of wafers by adjusting the distance between the centers in accordance with the angle of chamfer $\theta$, thickness t of the wafer, and so forth. Thus, for example, when D=110 mm, $\theta$=22, and t=0.6 mm, in FIG. 5, the angle between the perpendicular from the the center O of the polishing ring 26 to the chamfered portion 1*a*, and the line joining the centers of the two polishing rings 26 is equal to $\theta$ (=22), and since the thickness t of the wafer 1 is negligibly small compared with the diameter of the polishing ring 26, there is obtained $$1\times2\times55\cos 22^\circ \approx 102 \text{ mm.}$$

In this case, therefore, by considering the thickness of the polishing cloth 26b and also that the cloth is an elastic body, the distance between centers can be adjusted within the range of $97 \leqq l \leqq 107$.

In addition, in the peripheral flank machining device 8, the flank of the wafer 1 is machined with the polishing drum 50. In this case, the polishing drum 50 may be moved vertically with the motor 49 to preclude biased wear of the polishing drum 50, or the polishing drum 50 may be kept fixed vertically during machining of each wafer 1, and moved slightly upward or downward from one wafer to another.

Upon completion of specular machining as in the above, the chamfered portion machining device 7 and the peripheral flank machining device 8 recede and the supply of the chemical polishing agent is stopped. At the same time, the rotation of the polishing rings 26 and the polishing drum 50 is stopped, and the wafer 1 which has been sucked and held on the chuck table 9 is released.

Then, the transporting device 5 which has been waiting at the neutral position is actuated, and the machined wafer 1 on the chuck table 9 is placed on the receiving conveyor 65 of the unloader port 4, and an unmachined wafer 1 in the supply position of the loader part 3 is supplied onto the chuck table 9, by the action of the two arms 72 and 73, respectively.

The wafer 1 placed on the receiving conveyor 65 is washed with the washing brush 67 while subjected to the jetting of a washing solution such as deionized water while it is being transported, and then given to the takenout conveyor 69 and is sent to the takeout position where it comes into contact with the guide 68. Following that, the wafer is removed by the takeout arm 70 and is housed in the carrier 71, and is immersed into water by the descent of the carrier 71.

What is claimed is:

1. A specular machining apparatus for the peripheral edge portion of a wafer comprising:

a chuck table, having a chuck means for holding a wafer the peripheral edge portion of which is chamfered, for rotating the wafer held by the chuck means around the axis of the wafer, a front side polishing ring positioned to polish a peripheral, chamfered portion of a front face of a wafer held in the chuck means, and a rear side polishing ring positioned to polish a peripheral, chamfered portion of the rear face of said wafer, said polishing rings each defining a polishing surface on their respective outer peripheries, said polishing rings being each rotatable about an axis transverse to the axis of said wafer

2. A specular machining apparatus for the peripheral edge portion of the wafer as claimed in claim 1, wherein each polishing ring is made such that it can be brought into contact with its entire width with the entire width of the chamfered portion, by setting the diameter of the polishing ring to be sufficiently large compared with the width of the chamfered portion of the wafer, as well as the width of the polishing ring to be sufficiently small compared with the diameter of the wafer.

3. A specular machining apparatus for the peripheral edge portion of the wafer as claimed in claim 1, wherein a polishing drum for giving a specular machining to the peripheral flank of the wafer is disposed so as to be freely rotatable around an axis parallel to the axis of the wafer and to be freely accessible and recedable with respect to the peripheral flank of the wafer.

4. A specular machining apparatus for the peripheral edge portion of the wafer as claimed in claim 3, wherein the apparatus is equipped with a means for setting a force for bringing each polishing ring and the polishing drum into contact with the wafer under a constant force.

5. A specular machining apparatus for the peripheral edge portion of a wafer as claimed in claim 4, wherein the polishing force setting means has means for bringing each polishing ring and the polishing drum into contact with the wafer by gravitational force.

6. A specular machining apparatus for the peripheral edge portion of the wafer as claimed in claim 1, wherein the apparatus has a transporting device for taking out a machined wafer on the chuck table to a takeout position and bringing in an unmachined wafer placed on a supply position onto the chuck table, a supply means for sending out unmachined wafers housed in a carrier to the supply position one by one, a takeout means for housing into a carrier a machined wafer taken out to the takeout position, and a washing device for washing a machined wafer with a washing brush by jetting a washing solution on the wafer prior to housing it.

7. A specular machining apparatus for the peripheral edge portion of a wafer comprising:

a chuck table, having a chuck means for holding a wafer having a peripheral edge portion which is chamfered, means for rotating the wafer held by the chuck means around the axis of the wafer, and polishing ring means including a front side polishing ring for polishing a chamfered portion on the front face of the wafer and a rear side polishing ring for polishing a chamfered portion on the rear face of the wafer, said polishing rings being disposed so as to be rotatable in mutually opposite directions with their axes slightly shifted vertically and the distance between said axes freely adjustable, each of said polishing rings being made to be brought into contact along its entire width with the entire width of the respective chamfered portion of said wafer that it is intended to contact, the diameter of each polishing ring being sufficiently large compared with the width of the chamfered portion of the wafer, and the width of the polishing ring being sufficiently small compared with the diameter of said wafer to accomplish the above.

8. The specular machining apparatus of claim 7 in which a polishing drum for giving a specular machining to the peripheral flank of the wafer is disposed to be freely rotatable around an axis parallel to the axis of the wafer and to be freely accessible and retractable with respect to the peripheral flank of the wafer.

9. The specular machining apparatus of claim 8 in which the apparatus is equipped with means for setting a force for bringing the polishing ring means and the polishing drum into contact with the wafer under constant, predetermined force.

10. The specular machining apparatus of claim 7 in which the force setting means is constructed so that the polishing rings are brought into contact with the wafer by means of gravitational force exerted on a weight.

11. The specular machining apparatus of claim 7 in which said apparatus has a transporting device for moving a machined wafer on said chuck table to a takeout position and for bringing in an unmachined wafer from a supply station onto the chuck table, and supply means for delivering unmachined wafers housed in a carrier to the supply station one by one, and washing means for washing the machined wafer at the takeout position with a washing brush and washing solution on the wafer, plus means for installing the washed wafer into a housing.

12. A specular machining apparatus for the peripheral edge portion of a wafer comprising:

a chuck table having a chuck means for holding a wafer, the peripheral edge portion of which is chamfered, for rotating the wafer held by the chuck means around the axis of the wafer, a front side polishing ring positioned to polish a peripheral, chamfered portion of a front face of a wafer held in the chuck means, and a rear side polishing ring positioned to polish a peripheral, chamfered portion of the rear face of said wafer, said polishing rings each defining a polishing surface on their respective outer peripheries, said polishing rings being each rotatable about an axis transverse to the axis of said wafer in which said polishing rings are disposed so as to be rotated in mutually opposite directions with their axes shifted vertically and the distance between the axes being adjustable.

13. A specular machining apparatus for the peripheral edge portion of a wafer comprising:

a chuck table, having a chuck means for holding a wafer having a peripheral edge portion which is chamfered; means for rotating the wafer held by the chuck means around the axis of the wafer; and polishing means including a front side polishing ring for polishing a peripheral, chamfered portion on the front face of the wafer and a rear side polishing ring for polishing a peripheral chamfered portion on the rear face of the wafer, said polishing rings being disposed so as to be rotatable in mutually opposite directions with their axes shifted vertically and the distance between said axes being adjustable, each of said polishing rings being made to be brought into contact along its entire width with the entire width of the respective chamfered portion of said wafer that said ring is intended to contact, the diameter of each polishing ring being sufficiently large compared with the width of the chamfered portion of the wafer, and the width of the polishing ring being sufficiently small compared to the diameter of said wafer, to accomplish the above; a polishing drum for giving a specular machining to the peripheral flank of the wafer, said polishing drum being freely rotatable around an axis essentially parallel to the axis of the wafer and moveable to be freely accessible and retractable with respect to the peripheral flank of the wafer; and means for setting a force for bringing the polishing ring means and the polishing drum into contact with the wafer under constant, predetermined force, said force setting means being constructed so that the polishing ring and polishing drum are brought into contact with the wafer by means of gravitational force exerted on a weight.

14. The specular machining apparatus of claim 13 in which said apparatus has a transporting device for moving a machined wafer on said chuck table to a takeout position and for bringing in an unmachined wafer from a supply station onto the chuck table, and supply means for delivering unmachined wafers housed in a carrier to the supply station one by one, and washing means for washing the machined wafer at the takeout position with a washing brush and washing solution on the wafer, plus means for installing the washed wafer into a housing.

* * * * *